United States Patent [19]

Nielsen

[11] 4,341,160

[45] Jul. 27, 1982

[54] MOBILE MACHINE FOR THE TREATMENT OF RAILWAY TRACKS

[75] Inventor: Arne Nielsen, La Conversion, Switzerland

[73] Assignee: SIG Societe Industrielle Suisse, Neuhausen am Rheinfall, Switzerland

[21] Appl. No.: 127,377

[22] Filed: Mar. 5, 1980

[30] Foreign Application Priority Data

Mar. 23, 1979 [CH] Switzerland ..... 2725/79

[51] Int. Cl.[3] ..... E01B 29/04

[52] U.S. Cl. ..... 104/7 B; 104/8

[58] Field of Search ..... 104/7 R, 7 B, 8; 33/1 Q, 287, 338; 73/146

[56] References Cited

U.S. PATENT DOCUMENTS

| | | | |
|---|---|---|---|
| 2,974,607 | 3/1961 | Talboys | 33/287 X |
| 3,298,105 | 1/1967 | Stewart et al. | 33/287 |
| 3,659,345 | 5/1972 | Plasser et al. | 104/7 R X |
| 3,690,262 | 9/1972 | Plasser et al. | 104/7 R |
| 3,706,284 | 12/1972 | Plasser et al. | 104/7 B |

*Primary Examiner*—Randolph A. Reese

*Attorney, Agent, or Firm*—Hedman, Casella, Gibson & Costigan

[57] ABSTRACT

Railway track tamping machine comprising a leveling device regulated by two reference lines ($D_1$, $D_2$) each determined by the alignment of an emitter (9, 90), a mask (10, 100) and a receiver (11, 110) which are sensitive to the variations of illumination caused by the vertical displacements of the masks.

The masks (10, 100) are held at constant height from the lines of rails by a frame (2), while the emitters (9, 90) and the receivers (11, 110) borne by the two other frames (1, 3) are mounted in vertically adjustable fashion on them.

Controls (15, 16–14, 140) make it possible to maintain, under all conformations of the track, the two references lines ($D_1$, $D_2$) parallel to each other and to thus form a plane (P) to which the desired transverse inclination ($\alpha$) is imparted above the tamped region on which the frame (2) bearing the masks is supported.

3 Claims, 2 Drawing Figures

MOBILE MACHINE FOR THE TREATMENT OF RAILWAY TRACKS

Figure 1:
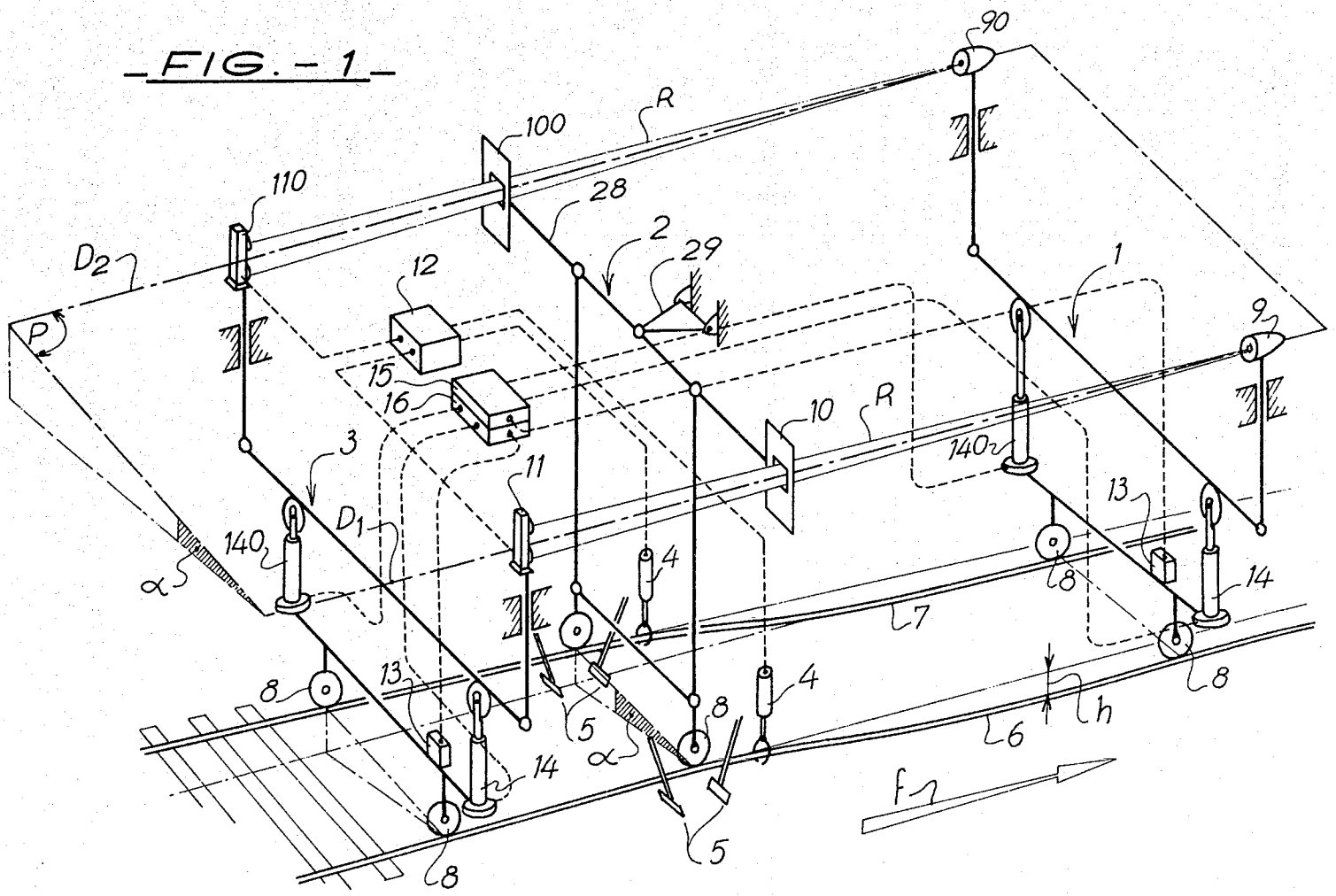

The object of the present invention is a mobile machine for the treatment of railway tracks, such as for instance a tamping machine or a ballast clearing and screening machine, equiped to effect the longitudinal and transverse leveling of the track as it advances in operation.

A tamping-leveling machine of this type is already known which has a leveling device such as described in the preamble to claim 1 and in which the three vertical position detectors of each of the two lines of rail are formed, in order, by the three elements, emitter, mask and receiver, of a luminous-beam measurement base. In this base the receiver has cells which are sensitive to the variations in illumination caused by the screening by the masks of the light rays coming from the emitter.

In this leveling device, the transverse frame supporting the two emitters comprises an apparatus for the measurement of transverse inclination and each of the two emitters is provided with an independent electrical vertical positioning mechanism while the other two frames support the two masks respectively and the two receivers maintain these elements at equal and constant heights from the two lines of rail. The two electrical vertical positioning mechanisms of the emitters are connected to a control device which has the effect of making the height of the latter different as a function of the desired transverse inclination at the place of the raised track—and by reference to the inclination measurement apparatus—that is to say at the place of the masks where it is thus aligned and raised to the required level both longitudinally and transversely.

This leveling device gives full satisfaction in particular, in straight sections and on large curves where the transverse inclination of the track is constant, that is to say where the transverse inclination posted and adjusted by the vertical positioning of the transmitters resting on the untreated track corresponds theoretically to the transverse inclination of the treated track on which the receivers rest.

In gradient transitions with a linear progression of the transverse inclination of the track, the inclination stipulated above the lifted track is different from that already adjusted above the treated track. This has the result that the reference lines of the measurement base form a skew surface and that as second consequence the transverse inclination which would have to be posted along the track not treated by differentiation of the height of the emitters is not the inclination prescribed at the place of the lifted track. This problem is solved in practice by adjusting the emitters on the untamped track to a prescribed desired inclination at the place of the said emitters and therefore shifted with respect to that stipulated at the place of the raised track.

However, a problem arises in transition zones and transitions in which the progression of the transverse inclination is not linear since in them at least one line of rails, the one on the outside of the curve, is no longer inscribed in the plane of measurement and deviates with respect to it. It is therefore necessary to take into account the camber which this line of rail must have at the place of the raised track in the determining function of the display inclination, and this presupposes a knowledge of the mathematical law of the transition in question, which is not always the case in practice, and requires the use of a calculator or tables.

Finally, on this tamping-leveling machine, the measurement of the actual transverse inclination at the place of the raised and tamped track, that is to say at the place of the frame supporting the masks, cannot be known by direct reading except by means of a clinometer attached to the said frame, since this inclination is not necessarily equal to the inclination posted, as has just been shown. And this raises the problem of the reliability of such a control measurement since the clinometer fastened to said frame is subject to substantial vibrations due to the work of the tamping tools. The same problem is also present on a ballast-clearing and screening machine equipped with a leveling device of this type due to the work of the scraper chains.

The leveling device of the machine in accordance with the invention provides a solution for all of these problems by the fact that it makes it possible in all the geometrical conformations of the track to maintain alignments, full curves, transitions and transition zones, the two reference lines parallel to each other so as to form a reference plane to which there is imparted the desired transverse inclination at the place of the region of raised, tamped track on which the two second detectors rest, by simultaneous display of the said inclination on the height regulating devices of the two first and two last detectors. Stated differently, this leveling device solves the problems indicated by eliminating their cause, namely the warping of the reference surface.

Other advantages which are inherent in the invention will become evident from the following description and the drawing which shows, by way of example, one embodiment of the object of the invention.

FIG. 1 of the drawing is a diagrammatic overall showing in perspective.

Figure 2:
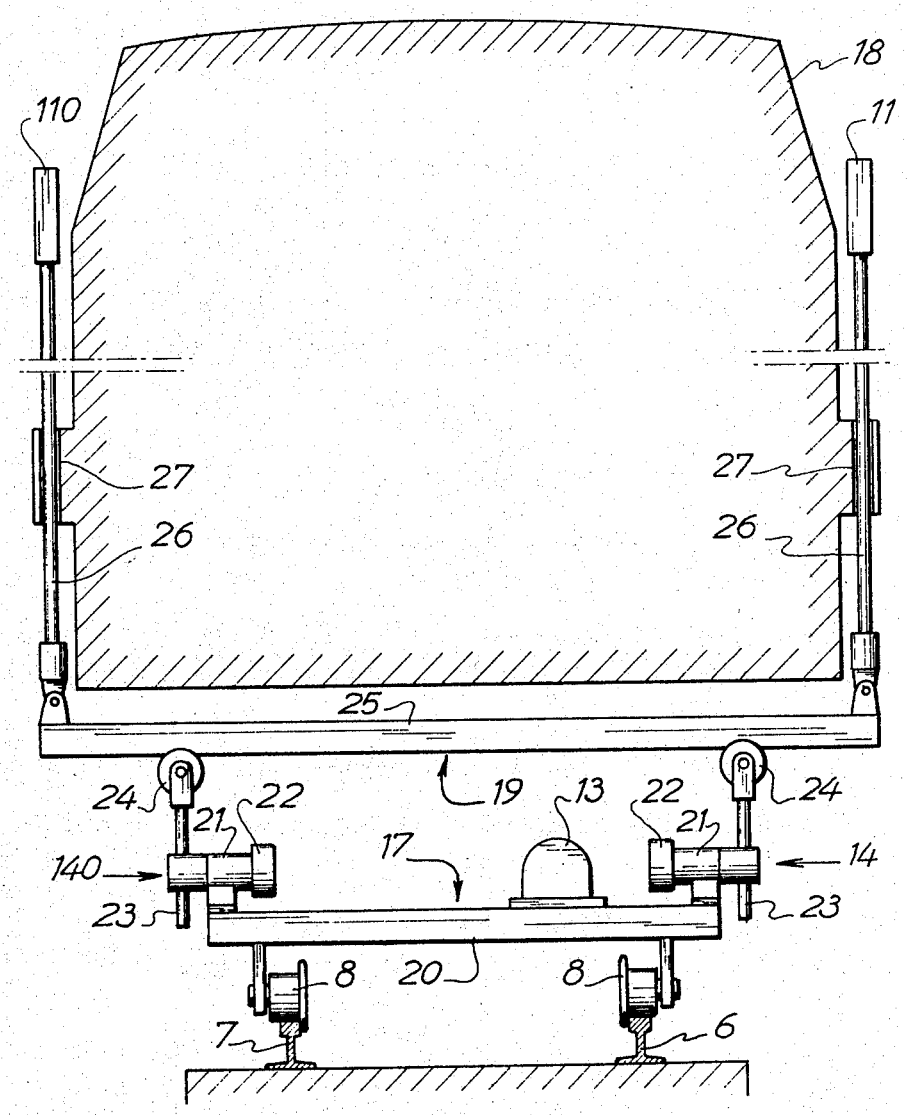

FIG. 2 is a detailed view in elevation of a part of FIG. 1.

In FIG. 1, only the leveling device which characterizes the machine in accordance with the invention, which is a tamping-leveling-straightening machine, has been shown.

This device comprises, arranged from right to left in the drawing, that is to say from the front to the rear of the machine, a first measurement frame 1, tools 4 for the lifting of the two lines of rail 6 and 7 of the track, tools 5 for tamping ballast beneath the raised ties, a second measurement frame 2, and a third measurement frame 3.

The three frames 1, 2 and 3 rest on the two lines of rail 6 and 7 via rollers 8 and, for each line of rail, support respectively three vertical position detectors, the first and last of which define reference lines $D_1$ and $D_2$ respectively.

The three detectors shown are in this case an emitter 9 (90) of luminous rays R, a mask 10 (100) with slit, and a receiver 11 (110) respectively. The latter is equipped with differential cells which are sensitive to variations in illumination caused by the vertical differences of the slit of the mask 10 (100) with respect to the reference line $D_1$ ($D_2$) and adapted to emit electric signals which are representative of the said differences. The sensitive cells of the two receivers 11 and 110 are connected to a device 12 for controlling the vertical displacements of the raising tools 4, which are also connected to the latter and controlled by signals coming from the said sensitive cells in customary manner.

The first frame 1 which bears the two emitters 9 and 90 and the third frame 3 which bears the two receivers 11 and 110 are each provided with a device 13 for measuring the transverse inclination of the track. This apparatus 13, for instance an electronic clinometer, is of the type adapted to give off an electric signal which represents the differences in inclination with respect to the horizontal reference.

These two frames 1 and 3 are also provided with two vertical regulating devices 14 and 140 for the two detectors which are associated with them, while the second frame 2 maintains the two masks 10 and 100 at constant, equal heights above the two lines of rail.

The clinometer 13 and the two regulating devices 14 and 140 of these two end frames 1 and 3 are connected to two control devices 15 and 16 respectively, which are adapted to give off signals for the differential control of the said regulating devices, the difference of which is proportional to the difference between the actual inclination of the track measured by the clinometer 13 and a desired inclination which can be posted, for instance, on the said control devices.

The first frame 1 and the third frame 3 have the feature that they are made in two parts mounted to slide one on the other in their plane transverse to the track.

This structure is shown in further detail in FIG. 2.

The lower part 17 of these two frames is located below the chassis 18 of the machine and is guided by the rollers 8 which rest on the two lines of rail 6 and 7 while the upper part 19 surrounds the said chassis and supports the detectors of these two frames, in this case the two receivers 11 and 110.

The lower part 17 has a cross member 20 supported by the rollers 8 and in its turn supporting the clinometer 13, as well as the two regulating devices 14 and 140. The latter are shifted towards the outside to the limit of the permitted gauge in order to maximize the distance which separates them, so as to increase the precision of the adjustment of the transverse inclination. Each of these two regulating devices consists of a rotary motor 21 driving a potentiometer 22 and imparting translation to a vertical rod 23 which bears a supporting roller 24 at its upper end.

The upper part 19 of these two frames has a cross member 25 resting on the rollers 24 and to the ends of which there are articulated two vertical columns 26 supporting here the two receivers 11 and 110 and sliding in two bearings 27 fastened to the outer walls of the chassis 18 of the machine.

The control devices 15 and 16 (FIG. 1) for the two regulating devices 14 and 140 are developed automatically to compensate for the fact that any lifting of one of the two detectors borne by these two frames results in a lowering of the other, due to the outward shift of the vertical columns 26 with respect to the vertical rods 23 of the said regulating devices.

The second frame 2 (FIG. 1) has a cross member 28 which connects the two masks 10 and 100 and which is immobilized transversely by a triangulated articulation 29 fastened to the chassis of the machine, while the rest of this frame is shaped as an articulated parallelogram resting on its rollers 8.

In this way, the two emitters 9 and 90, the two masks 10 and 100, and the two receivers 11 and 110 can be maintained at equal distances from the central longitudinal plane of the machine, regardless of the relative transverse displacements of the rollers 8 with respect to this plane which are produced, in particular, along curves. As a result, the width of the slits of the masks 10 and 100 may be reduced to the minimum necessary for the illuminating of the sensitive cells of the receivers, which makes it possible advantageously to reduce the lateral size of these masks.

On the other hand, the offset of the transmitters and receivers towards the outside of the chassis of the machine makes it possible to avoid the crossings of the chassis, which is advantageous in particular at the level of the cabs in which these crossings take up space and complicate the air-conditioning problems.

In FIG. 1, the line of rail 6 is to be considered as the guide line of rail on basis of which the longitudinal leveling and the transverse leveling are adjusted.

The tamping machine moving from left to right in the direction indicated by the arrow F; the result is that the two emitters 9 and 90 are resting on the untreated track and that the two receivers 11 and 110 are resting on the treated track while the two masks 10 and 100 are resting on the area of track which is disturbed by the tamping tools 5 and lifted by the lifting tools 4.

The zero of this leveling device is considered shifted for the longitudinal leveling by a certain imposed value of lift h in customary manner while the zero of the transverse leveling is considered as corresponding to the horizontal.

In this conformation, the leveling of the track is effected, as already indicated, by simultaneous posting of the transverse inclination $\alpha$ of the track, desired at the tamped and raised region on which there rests the second frame 2 bearing the masks 10 and 100, on the two control devices 15 and 16 of the vertical regulating devices 14 and 140 of the emitters and receivers defining the two reference lines $D_1$ and $D_2$. This value of inclination $\alpha$ being thus the same for the two frames 1 and 3 bearing these elements, the result is that the two reference lines $D_1$ and $D_2$ are always maintained parallel and inscribed in a plane P of the same transverse inclination $\alpha$. And this is true whatever the geometrical conformation of the track, in particular in transition regions and transition gradients in which the progression of the transverse inclination of the track does not follow a linear law and which cause the problems mentioned at the beginning hereof.

The transverse inclination of the track at the place of the tamped and raised region is thus always adjusted to the desired inclination $\alpha$, within the limits of linearity of the sensitive cells of the receivers 11 and 110, and this dispenses with the necessity of installing an instrument for checking the said inclination on the frame 2 resting on said region which has been disturbed by the tamping tools, an advantage which has already been indicated.

It goes without saying that the leveling device described is suitable for all methods of leveling based either on the selection of a guide track line as shown in FIG. 1 or on a fictitious average line.

As a variant, when the passage of the frames through the chassis of the machine will not constitute a problem, the vertical uprights 26 of said frames can be arranged directly above the vertical rods 23 of the regulating devices 14 and 140.

Finally, in this latter case also, the frames 1 and 3 need not be made in two sliding parts and may be articulated to the chassis of the machine in a manner similar to the second frame 2, so as to permit relative transverse mobility of the supporting rollers 8 with respect to the said chassis. In such an embodiment, the adjusting devices 14 and 140 would, for instance, constitute the two vertical sides of an articulated parallelogram, the other two sides of which would be formed of a bottom cross member supported by the rollers 8 and a top cross member connecting the two detectors.

What is claimed is:

1. A mobile machine for the treatment of railway tracks equipped with a device for the longitudinal and transverse leveling of the track comprising tools for the lifting of each line of rails, tools for distributing the ballast below the raised ties, and a device for measuring and controlling the extent of the lifting comprising:

(a) a pair of first vertical position detectors respectively located headway of the machine above each line of rails of the untreated track;

(b) a pair of second vertical position detectors respectively located above each line of rails in the area of lift of the track, at an invariable distance from the line of rails;

(c) a pair of third vertical position detectors respectively located at the rear of the machine above each line of rails of the treated track;

(d) liaison means (R) respectively joining the first detector to the third detector in each of said pairs of first and third detectors to define two reference lines;

(e) sensitive means respectively arranged on the detectors of one of said pairs of first, second and third vertical position detectors to give off signals representing differences in the respective vertical positions of each said second detectors with respect to said reference lines;

(f) a first frame means resting on both lines of rails transversely to the track for supporting said pair of first vertical position detectors, said first frame means being formed of two parts mounted slidably one on the other in the plane transverse to the track, one of said parts being connected to the track by rollers which rest on the two lines of rails while the other of said two parts is connected to the machine;

(g) a second frame means resting on both lines of rails transversely to the track for supporting said pair of second vertical position detectors;

(h) a third frame means resting on both lines of rails transversely to the track for supporting said pair of third vertical position detectors, said third frame means being formed of two parts mounted slidably one on the other in the plane transverse to the track, one of said parts being connected to the track by rollers which rest on the two lines of rails while the other of said two parts is connected to the machine;

(i) a height control means for controlling the vertical displacements of said lifting tools in response to said vertical position difference signals;

(j) a first means for measuring the transverse inclination of the track and give off signals representing the differences in inclination thereof with respect to the horizontal, said first measuring means supported by said first frame means;

(k) a second means for measuring the transverse inclination of the track and give off signals representing the differences in inclination thereof with respect to the horizontal, said second measuring means supported by said third frame means;

(l) a first pair of height regulating means arranged on said first frame means for respectively regulating the height of the detectors of said pair of first vertical position detectors;

(m) a second pair of height regulating means arranged on said third frame means for respectively regulating the height of the detectors of said pair of third vertical position detectors;

(n) a first control means respectively connected to said first transverse inclination measuring means and to said first pair of height regulating means for giving off differential control signals for said first pair of height regulating means the difference of which is proportional to the difference between the actual inclination of the track measured by said first transverse inclination measuring means and a desired inclination ($\alpha$); and (o) a second control means respectively connected to said second transverse inclination measuring means and to said second pair of height regulating means for giving off differential control signals for said second pair of height regulating means, the difference of which is proportional to the difference between the actual inclination of the track measured by said second transverse inclination measuring means and said desired inclination ($\alpha$), whereby said reference lines defined by said liaison means (R) are maintained parallel and inscribed in a plane (P) having the said transverse inclination ($\alpha$) whatever the geometrical conformation of the track.

2. A machine according to claim 1, wherein the part connected to the track comprises a cross member resting on said rollers and supporting said means for measuring the transverse inclination of the track and said height regulating means, and wherein the part connected to the machine comprises a further cross member resting on said height regulating means.

3. A machine according to claim 2, wherein said first detectors and said third detectors are respectively mounted on the upper ends of vertical columns which slide vertically in bearings fastened to the outside of the machine, and wherein the lower ends of said vertical columns are articulated at the ends of said cross member resting on the height regulating means.

* * * * *